US005314188A

United States Patent [19]

Mason et al.

[11] Patent Number: 5,314,188

[45] Date of Patent: May 24, 1994

[54] COMPETITION GAME

[76] Inventors: Henry Mason; Rhonda Mason, both of 3625 S. Lake Park #904, Chicago, Ill. 60653

[21] Appl. No.: 52,764

[22] Filed: Apr. 26, 1993

Related U.S. Application Data

[63] Continuation-in-part of Ser. No. 856,567, Mar. 24, 1992, abandoned.

[51] Int. Cl.[5] ..... A63F 3/00

[52] U.S. Cl. ..... 273/251; 273/138 A; 273/287

[58] Field of Search ..... 273/251-254, 273/237, 249, 256, 287, 138 A

[56] References Cited

U.S. PATENT DOCUMENTS

| | | | |
|---|---|---|---|
| 3,924,858 | 12/1975 | Dittrich et al. | 273/254 |
| 4,087,094 | 5/1978 | Bakay | 273/254 |
| 4,375,889 | 3/1983 | Burkett | 273/254 |
| 4,953,871 | 9/1990 | Antwi | 273/252 |
| 5,050,887 | 9/1991 | Kemp | 273/237 |

FOREIGN PATENT DOCUMENTS

| | | | |
|---|---|---|---|
| 2224451 | 5/1990 | United Kingdom | 273/252 |

*Primary Examiner*—Benjamin H. Layno
*Attorney, Agent, or Firm*—Paul H. Gallagher

[57] ABSTRACT

Game for a plurality of players, including a game board having a path made up of a plurality of squares, and playing pieces are moved along the path according to numbers produced by dice thrown. Beginning signals are given by a color light (traffic light) member. Similar color lights are indicated on certain squares, constituting instructions to the players. The squares also contain additional, written instructions. The playing pieces are figures of adults and children, family members, either in 3-D or flat picture form. The game includes cards of different colors, green and red, to correspond with colors of the color lights, separate and detached from the playing board, that include additional instructions to the players. A check list includes identification of the players and the playing pieces represent members of a family of each the players; this check list includes boxes for the scores of each of the playing pieces and thus of the players.

8 Claims, 3 Drawing Sheets

Fig. 12
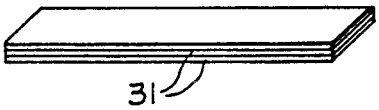
Fig. 13
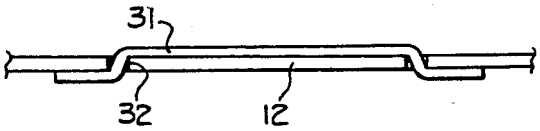
Fig. 14
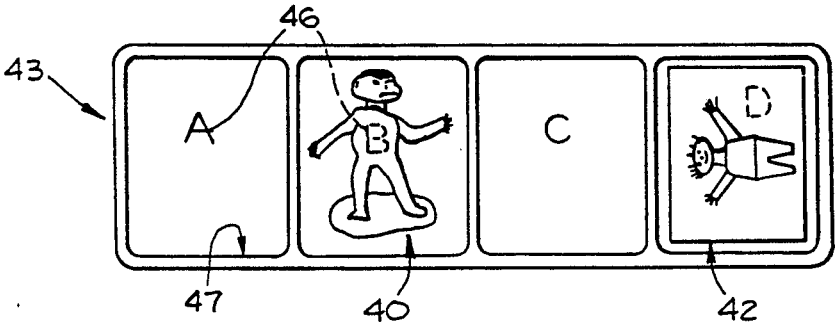
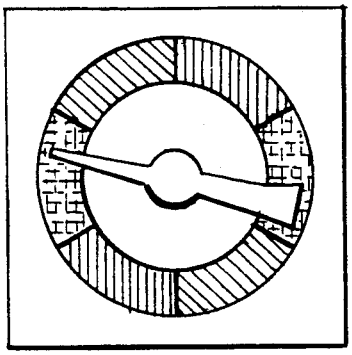
Fig. 15

COMPETITION GAME

This is a continuation-in-part of our prior and copending application Ser. No. 07/856,567, filed Mar. 24, 1992, of the same title, now abandoned.

Record is made of Disclosure Document No. 289610.

SUMMARY OF THE INVENTION

The invention resides in a game of the kind that includes a game board that is used by a plurality of players in competition. The game includes a number of playing pieces that are moved by the players along a path on the board, according to certain chance indications and instructions. The game includes indicators, that are manipulated by the players, instructing the players when to begin moving the pieces, the sequence of plays by the players, and the extent of movement of the pieces. The game board also includes instructions at different locations along the path mentioned.

A broad object of the invention is to provide a game of the character referred to having a novel arrangement, in which lights and colors are utilized for producing indicating signals, used in the game.

Another object is to provide a game of the foregoing general character, in which each of the players represents a family, and has a number of figures representing members of the family, these members of the family being moved along the path, in an arrangement producing unusual interest because of the indicated family relationship.

Still another object is to provide a game of the foregoing character, utilizing additional articles or items, separate from the board, indicating progress of the players along the path, and further indicating success or failure in the final tabulation of steps in the playing moves.

An additional object is to provide a game of the foregoing character having an unusual arrangement of representations of traffic lights serving as signal indicators to the players.

An additional object is to provide a game of the foregoing character having a novel arrangement of traffic light indicators along the path of the movement of the pieces.

BRIEF DESCRIPTION OF THE SEVERAL VIEWS OF THE DRAWINGS

FIG. 12 is a perspective view of a stack of name slips.

FIG. 13 is a sectional view taken at line 13—13 of FIG. 2.

FIG. 14 is a face view of a tray for holding playing pieces.

FIG. 15 shows a spinner forming an alternative means for random selection of traffic light colors.

DETAILED DESCRIPTION

Figure 1:
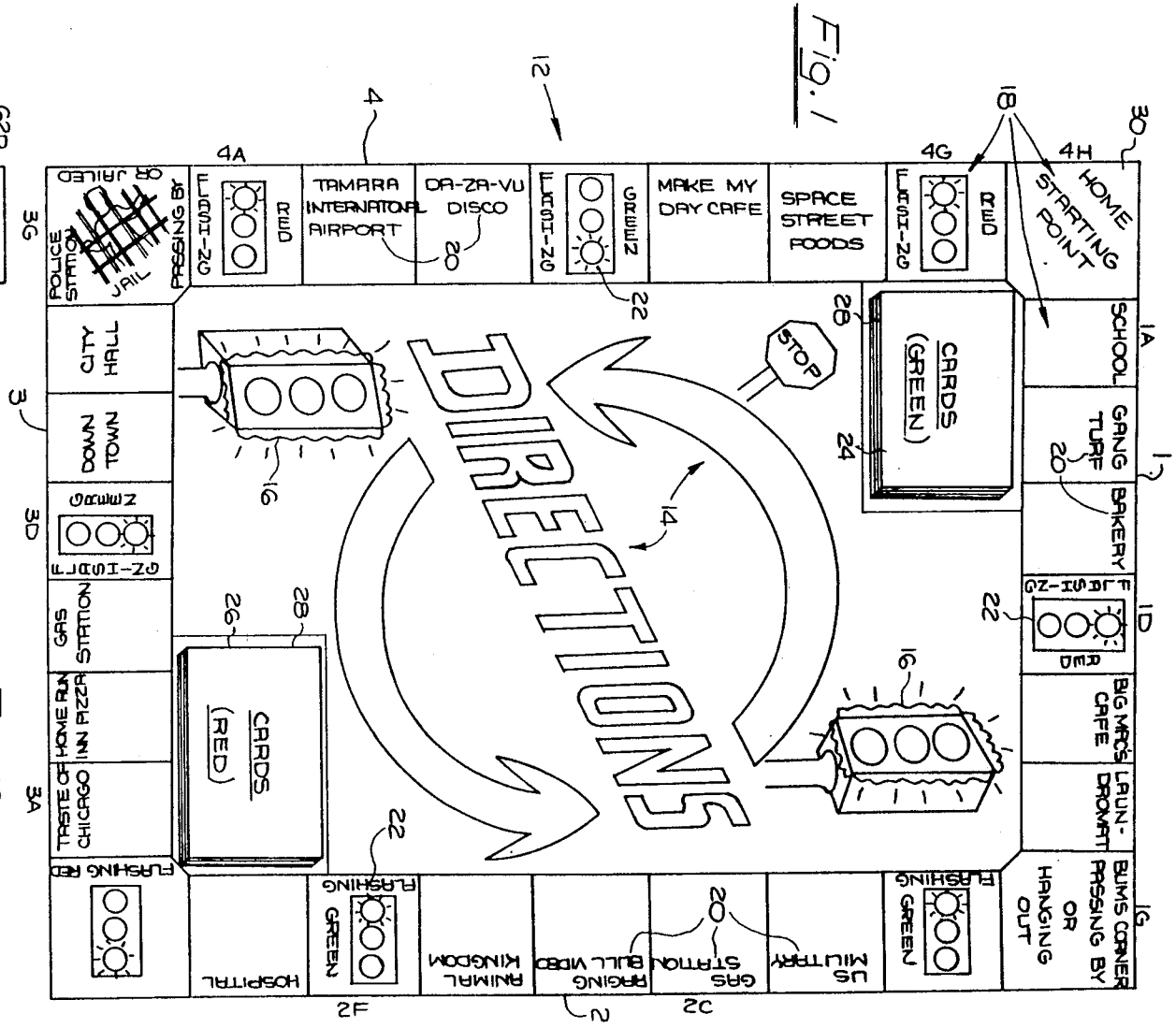
FIG. 1 is a face view of the game board of the game.

The game board of the invention is shown at 12 in FIG. 1, which may be of any suitable size for four persons to be seated thereat, and may be made of any suitable material, wood, cardboard, etc. The game board, which may also be referred to as a board, is shown in face view, and includes various illustrations and inscriptions thereon, to be referred to again hereinbelow. A title with decorations or embellishments is shown at 14, and the illustrations include traffic lights 16 characteristic of the nature of the game and the playing thereof.

Around the periphery of the board is a path 18 made up of a plurality of squares or areas, in this case abutting each other and extending around the entire periphery of the board. For convenience the sides of the board are identified as 1, 2, 3, 4, and the squares are identified according to those side edges, those on each side being individually identified with the side number and capital letters, for example 1A, 1B, 2A, 2B, etc. These numerals and letters increase or advance in clockwise direction. At the upper left hand corner of the board, as oriented in FIG. 1, the square, identified as 4H, is the home square which may also be referred to as home plate, constituting the starting point, and the end, for the playing pieces, to be moved around the path, as described below.

The squares in the path 18 are provided with various inscriptions 20 which are utilized in the playing of the game, and as illustrated, may be locations, or the names of establishments, such as school, cafe, gas station, etc.

Additionally in certain of the squares of the paths are representations of traffic lights, 22, with the inscription "flashing" and the color of the light. The colors of the lights or electric lamps as represented in these traffic lights are arranged in the same order as in actual traffic lights, namely red at the top, yellow in the middle and green at the bottom. Although the word flashing is used, the illustration on the board is actually of course only an illustration and flashing is also indicated by radial lines. The particular color involved at each location is represented by color-lining of the lens.

Figure 7:
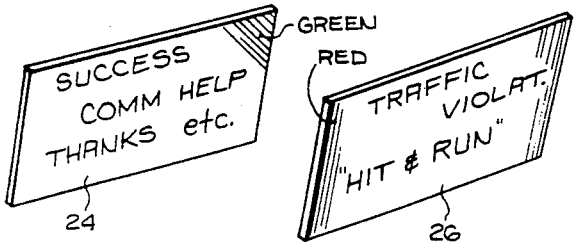
FIG. 7 is a perspective view of representative cards bearing instructions corresponding to certain steps in the movement of the playing pieces.

Associated with the board, and preferably mounted in stacks thereon, are cards 24, 26, green and red respectively, for use in playing the game as described below. If desired the cards may be fitted in a box or rack 28. These cards are of course free of attachment to the board and are picked up by the players, in the various steps in playing the game. These cards also bear inscriptions described hereinbelow. They are also shown in FIG. 7.

Figure 2:
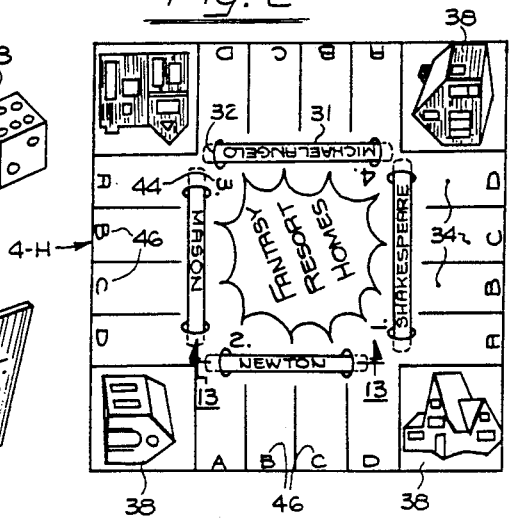
FIG. 2 is a large scale view of the home square in the path of movement of the pieces, on the game board.

FIG. 2 shows an enlargement of the square 4H of the game board (FIG. 1) which as noted above is the starting point and end of the path 18. The square 4H includes means for identifying the players, temporarily, or during each game played. For this purpose, a plurality of name slips 31, (FIG. 12) are provided, bearing names, preferably fictitious names, or names of prominent people, for example, and the board has a pair of slots 32 at each side of the square 4H. In beginning the game, each player selects a slip, the slips bearing different names. He then inserts the ends of the slip into the slots 32, as shown in FIGS. 2 and 13. The slips so positioned are related to corresponding sides of the playing board, and they thereby identify the players at those sides respectively. In each game, the players are free to select different slips. Each player represents a family, having the name shown on corresponding slips. Other members of each family are represented by playing pieces as referred to hereinbelow. Also included in the square 4H are areas or stalls 34 at each side for placing the playing pieces therein, at the beginning of each game. These stalls are further identified, by the letters A, B, C, D. At the corners of the square are illustrations 38 of homes of the families, being situated at the right hand end of the family stalls, respectively. The shading of the homes does not represent color, but is only decorative.

Figure 3:
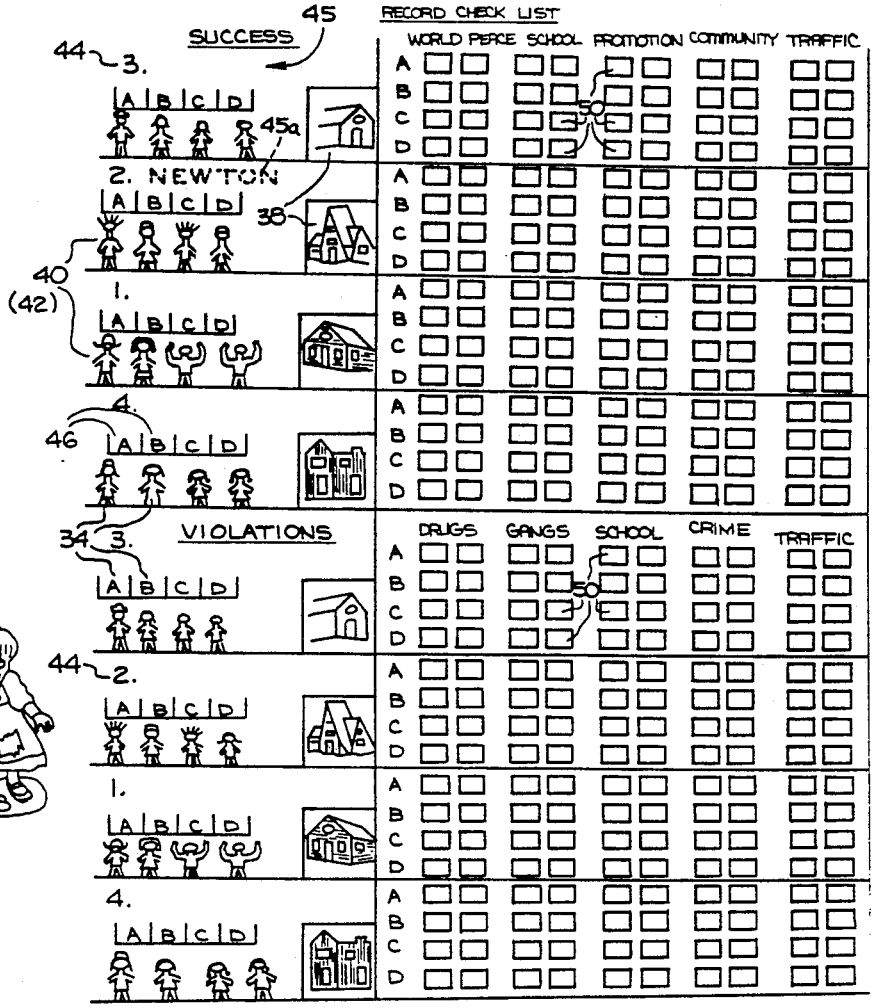
FIG. 3 shows a record checklist.
Figure 4:
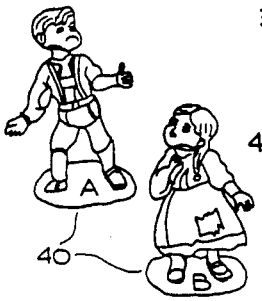
FIG. 4 is a perspective view of one form of pieces that are moved, in this case, 3-D figures of children.
Figure 5:
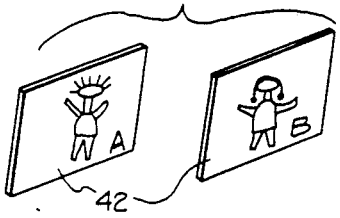
FIG. 5 is a perspective view of another form of playing pieces that are moved, in this case, pictures of adults or children, or adult and child.

The playing pieces are representations of adult and family members, child or adult, or children, i.e., and may be 3-D FIGS. 40 as in FIG. 4, or pictures 42 as in FIG. 5. For holding the playing pieces, a plurality of trays 43, (FIG. 14) are provided, one for each player. The trays may be of any suitable material, e.g., plastic, and each includes a plurality of recesses 47, for example four, for receiving and holding his playing pieces for the game. Whichever form of playing pieces are used, i.e., 40 or 42, they are placed in the recesses and held temporarily during the game. FIG. 14 shows one of each form of playing piece, but in any one game normally only those of one kind would be used. The group of playing pieces of each player, (each family) are identified by a numeral 44 and the individual ones of each family by the letters 46. These numerals and letters appear in FIGS. 3 and 2.

Figure 6:
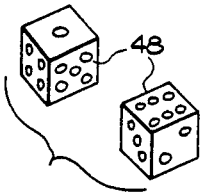
FIG. 6 is a perspective view of a pair of dice used in the game.

The game also includes a pair of dice 48 (FIG. 6).

FIG. 7 shows one of each of green and red cards, 24, 26, which have inscriptions thereon as shown and as referred to again hereinbelow. The green cards represent successes, and the red cards represent violations. These are picked up by the individual players in accordance with instructions encountered in the playing of the game, as referred to hereinbelow. As the game is played, and the playing pieces moved around the path, points are accumulated by the players, which may be either successes or violations. FIG. 3 shows a record checklist for tallying those points. A plurality of these checklists are provided, one being used for each game and are of throwaway character. This checklist includes two main parts, the upper half showing successes, or awards, and the lower half violations or penalties. In each half, the families are indicated by the numerals 44, and following each numeral is a space 45 in which the player may write in the name he has selected as a family name, as indicated at 45*a*. Also in the checklist are the stalls 34 with the identifying letters 4 and the playing pieces 40. The playing pieces 40 are 3-D figures, as noted above, and the pieces 42 are pictures, and either may be used selectively, as desired. FIG. 3 also shows homes 38 associated with the families, identified above. At the right hand side of the checklist, in each the top and bottom part, are squares 50, arranged in columns under appropriate headings in each part, in the upper part, successes, such as world peace, school, etc., and in the lower part, violations, such as drugs, gangs, etc. At the left of the squares 50, are the letters 46 identifying adults and children figures of each family. As the game is played, appropriate entries are made in these squares according to the progress of the playing pieces around the path 18.

Figure 8:
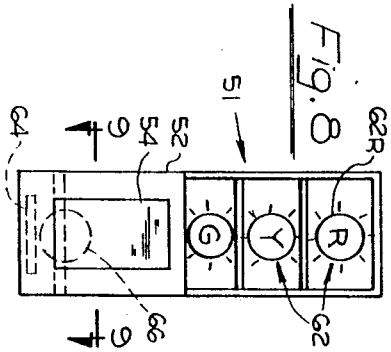
FIG. 8 is a view of a signal indicator, constituted by a traffic light.
Figure 9:
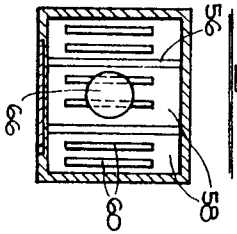
FIG. 9 is a sectional view taken at line 9—9 of FIG. 8.
Figure 10:
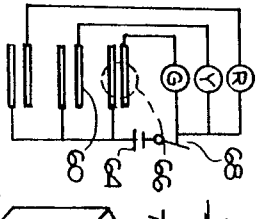
FIG. 10 is a diagram of the electrical system of FIGS. 8 and 9.

As indicated above, the traffic light constitutes an attractive characteristic of the game. In this case an actual illuminating electric model traffic light is utilized, an example of which is indicated at 51 in FIGS. 8–10. This traffic light includes a lower box element 52 which may have a window 54 therein. At the bottom of the box (FIG. 9) are partitions 56 forming three cells 58, each of the cells including a pair of electrical contacts 60. The pair of contacts in each of the cells corresponds with a related one of the traffic light electric bulbs 62, individually identified 62R, 62Y, 62G, representing red, yellow and green lights respectively. FIG. 10 shows the electrical circuit including the contacts 60 and their connections with the light bulbs 62. An electrical battery 64 is mounted in the lower end of the box, and in the box 52 is a loose steel ball 66.

The light fixture 51 is separate from the game board, and can be picked up and shaken. When it is then set down, the steel ball 66 falls into one of the cells 58, and completes the circuit to the respective one of the three lights 62, and the color of the light that is lighted, determines the next play to be made by the player. A switch 68 may be included to shut off the light if desired, through a longer period of playing.

Figure 11:
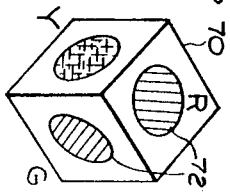
FIG. 11 is a perspective view of a single die, with traffic light colors thereon.

While the electric traffic light 51 is preferred, it is also within the scope of the invention to provide a single die for determining the color to be utilized. Such a die is shown at 70 in FIG. 11, which is provided with red, yellow and green spots 72 respectively. Upon throwing this die, the color at the top determines the play. These colored spots may be provided on only three sides of the die, but if desired they may be provided on all the sides.

A still further device is shown in FIG. 15, for selection of traffic light colors. In this figure, a spinner 72 is shown. A card 74 has a design 76 thereon containing arrow 78 which upon being spun, determines the play. The selection devices 51, 70, 72 are representative forms of generic means for the purpose.

There may be provided as many green and red cards, 24, 26, as desired, and each has an inscription or instruction, representing success or violation. For example a green card may state:

SUCCESS
Community Health
Thanks For Your Donation to the Homeless
A+ SUPPORT

A red card may have the following inscription, for example:

CRIME VIOLATION
Slick Ice
Arrested for Burglary and Shoplifting.
Lose 1 turn.
Double before Moving.

There is practically no limit to the number and variety of the inscriptions and instructions that may be provided on these cards.

The following is a description of the steps to be followed in the actual playing of a game. It will be understood of course that these steps may be altered, if and when desired.

In the playing of the game, the players take seats to the board 12 in the places indicated by the names 32 in FIG. 2. Each player places the family member figures, 40 or 42, in his tray 43, according to the identifying letters 46, these same letters being also on the figures as indicated above. The specific steps in playing the game are set out below.

OBJECT OF GAME

The player who returns the most family members to Home Square wins the game.

PLAYING THE GAME

1) To begin, each player rolls one die 48 and the players then proceed in the order from the highest to the lowest number of points occurring in such rolls.
2) Each player activates the light (each in turn unless instructed differently), to determine if that player will begin moving playing pieces. As these steps proceed in the case of each player, if the light stops on:
   RED—"Stop." No moves. Next player's turn.
   YELLOW—"Slow Down." Player gets another chance; if on second shake, a YELLOW again shows, it is an automatic RED and next player's turn; if on second shake, GREEN shows, he begins play.
   GREEN—"Go." Player begins play.
3) Each player moves one family member at a time, around the board in the order that the family members are disposed on home plate, according to the letters A,B,C,D.
4) Each family member must get around the board once, and return to home plate, (unless eliminated), before the player can proceed to move the next family member out of Home Square.
5) If a family member lands on any traffic light on the board, the player must pick a card that corresponds with that color light on the board, i.e., red card, or green card.
6) If any family member gets two violations from instructions given on the cards, in either of the following areas; Drugs, Gangs, School, Crime or Traffic, that family member will then become eliminated from the game.
7) If any family member is successful twice from instructions given on the cards, in either of the following areas; World Peace, School, Community Help, Promotions or Traffic, that family member is rewarded by advancing to Home, and moving the next family member (if any) out, or, a player may return any family member back home that has been eliminated from the game and that family member must start over.
8) One player must keep a record at all times of each family member's successes, violations, and eliminations.
9) At any square from 3E to 4A, you must decide whether you are going to take one big roll to reach Home Square or several small rolls to reach it (you cannot over roll Home Square). A big roll is using two dice, and a small roll is using one die.
   Examples:
   a) Suppose you are on level 4 at square 4A: You decide to take several small rolls to reach home square (at that point you should roll only one die. You activate traffic light and get a green light which means go, you proceed to throw the one die and get five on the die and move the playing piece 5 spaces, on your next turn you must get a green light and two on the die before entering home square.
   b) Suppose you are on level 4 at square 4A. You decide to take the big roll to reach home square (at this point you should roll two dice). You activate traffic light and get a green light which means go. You proceed to roll the two dice and get a total of seven. You will then move into home square and your next playing piece will proceed on your next turn.

After deciding the type of roll you are going to take you must get a green light before moving and use the correct number of dice.
   A. If you decide to take several small rolls you must use one die. Small roll = 1 to 6 on the die.
   B. If you decide to take the big roll you must use two dice. Big roll = 7 to 12 on the dice.

Once your turn comes around again, you have the choice of whether you will keep the same roll you had or change it for another.
10) After each player has gotten as many of his family members home as possible, he must then wait to see if his neighbors will get more or fewer members home (unless a player returns all 4 members home, then he is the winner).
11) If there is a tie because two or more players have returned the largest numbers of family members to home space, then those players enter into the probation period.
   Examples:
   Family 3—Your family has returned home with 3 members.
   Family 2—Your family has returned home with 2 members.
   Family 1—Your family has returned home with 1 member.
   Family 4—Your family has returned home with 3 members.
12) The member that was eliminated (only one) will return to the game. At that point the game will start over with just those members— the member who reaches home first will be the winner.

We claim:

1. A competition game adapted for playing by a plurality of players, comprising, a rectangular game board having squares around its periphery, the squares including a) a home square forming a beginning and ending location, b) other squares bearing instructions, a plurality of name slips, one for each player, each name slip having identification means identifying each player, said home square comprising a plurality of pairs of slots wherein one pair of slots is located on each side of the home square, the sides of the home square corresponding to the sides of the game board, and each pair of slots is adapted to receive a name slip such that when all the name slips are received in the slots, the position of the name slips relate to the corresponding sides of the game board, thereby identifying the players at those sides respectively, a plurality of sets of playing pieces, one set for each player, the playing pieces adapted to be placed on the home square, and successively moved onto different ones of the other squares, each set of playing pieces having a first identification means for identifying each set of playing pieces and a second identification means for individually identifying each playing piece in a set, and indicating means capable of indicating one of green, yellow, red colors randomly in response to manipulation thereof by a player, the game includes instructions of actions to be taken by the players according to colors respectively.

2. A competition game according to claim 1 wherein, certain of the other squares include representations of lights of said colors constituting instructions to the players for moving the playing pieces.

3. A competition game according to claim 2 and including, green and red cards separate from the board, and bearing messages of successes and violations respectively, and said other squares that include the representations of the green and red lights bear instructions for selecting the green and red cards respectively.

4. A competition game according to claim 1 wherein, the identification means on the play slips consist of family names, and each set of playing pieces represents a family and the individual playing pieces of a set represent members of a family.

5. A competition game according to claim 1 wherein, the home square further includes pictures of different houses for further identifying each player.

6. A competition game according to claim 5 and including a record check list including identification of the players, and a set of boxes, in which check markings are to be entered, positionally associated with the respective players, and with each of the playing pieces of each player.

7. A competition game according to claim 4 wherein, the playing pieces are 3-D figures.

8. A competition game according to claim 1 wherein, the light indicator is a self contained unit separate from the board, and of the character of a traffic light including an electrical circuit and electric light bulbs for producing lights of said colors.

* * * * *